US007287974B2

(12) United States Patent
Rheims et al.

(10) Patent No.: US 7,287,974 B2
(45) Date of Patent: Oct. 30, 2007

(54) CALENDER ARRANGEMENT

(75) Inventors: Jörg Rheims, Tönisvorst (DE); Lothar Zimmerman, Krefeld (DE); Eugen Schnyder, Waltenschwill (DE)

(73) Assignee: Voith Paper Patent GmbH, Heidenheim (DE)

( * ) Notice: Subject to any disclaimer, the term of this patent is extended or adjusted under 35 U.S.C. 154(b) by 240 days.

(21) Appl. No.: 11/224,220

(22) Filed: Sep. 12, 2005

(65) Prior Publication Data

US 2006/0054032 A1 Mar. 16, 2006

(30) Foreign Application Priority Data

Sep. 14, 2004 (DE) ..... 10 2004 044 389

(51) Int. Cl.
*D21G 1/00* (2006.01)

(52) U.S. Cl. ..... 425/363; 162/358.4; 162/901; 425/373; 100/176

(58) Field of Classification Search ..... 162/358.3, 162/358.4, 361, 901; 425/363, 373; 100/176
See application file for complete search history.

(56) References Cited

U.S. PATENT DOCUMENTS

| | | | | |
|---|---|---|---|---|
| 4,944,844 | A * | 7/1990 | Marcinko | 162/205 |
| 4,946,731 | A * | 8/1990 | Dutt | 428/156 |
| 5,791,245 | A | 8/1998 | Schnyder et al. | 101/153 |
| 6,136,151 | A * | 10/2000 | Davenport et al. | 162/306 |
| 6,383,339 | B1 * | 5/2002 | Gstrein | 162/358.4 |
| 6,455,448 | B1 | 9/2002 | Davenport et al. | 442/148 |
| 6,682,467 | B2 * | 1/2004 | Zimmermann et al. | 492/50 |
| 6,695,756 | B1 | 2/2004 | Sohl | 492/56 |
| 6,837,157 | B2 | 1/2005 | Suzuki et al. | 100/47 |
| 7,005,042 | B2 * | 2/2006 | Danzler | 162/358.4 |
| 7,011,730 | B2 * | 3/2006 | Davis | 162/358.4 |
| 7,011,731 | B2 * | 3/2006 | Romanski | 162/358.4 |
| 7,014,733 | B2 * | 3/2006 | Gustafson et al. | 162/358.4 |
| 2001/0021437 | A1 | 9/2001 | Sakuma et al. | 428/167 |
| 2004/0144515 | A1 | 7/2004 | Danzler | 162/358.2 |
| 2004/0219346 | A1 | 11/2004 | Gustafson et al. | 428/292.1 |

FOREIGN PATENT DOCUMENTS

| | | |
|---|---|---|
| EP | 1 333 121 | 8/2003 |
| WO | WO 01/44570 | 6/2001 |

* cited by examiner

*Primary Examiner*—James P. Mackey
(74) *Attorney, Agent, or Firm*—Taylor & Aust, P.C.

(57) ABSTRACT

A calender arrangement for calendering a material web, in particular a paper web, having a shoe roll and a mating roll, between which an extended nip is formed, through which the material web can be guided. The shoe roll includes a revolving shell, which is fixed to two rotatably mounted terminating elements arranged at the ends and can be loaded in the direction of the mating roll via a press shoe matched to the outside of the mating roll. The shell includes a radially inner base layer and an adjacent, radially outer functional layer. The base layer includes a resilient matrix material reinforced by embedded fibers, and the functional layer includes a matrix material with a lower fiber content than the base layer.

50 Claims, 2 Drawing Sheets

CALENDER ARRANGEMENT

BACKGROUND OF THE INVENTION

1. Field of the Invention

The present invention relates to a calender arrangement for calendering a material web, in particular a paper web, having a shoe roll and a mating roll, between which an extended nip is formed, through which the material web can be guided. The shoe roll includes a revolving shell, which is fixed to two rotatably mounted terminating elements arranged at the ends and can be loaded in the direction of the mating roll via a press shoe matched to the outside of the mating roll.

2. Description of the Related Art

By using calender arrangements, material webs such as paper or board webs are calendered in order to obtain the desired surface quality. In this case, what are known as extended nip calenders in particular have proven worthwhile, in which the shell running over the press shoe of the shoe roll includes a relatively soft material, for example of polyurethane. The desired surface quality of the material webs is, in this case, achieved by applying pressure and heat by the mating roll normally being constructed as a heatable roll and the material webs guided through the extended nip being pressed in the direction of the heated mating roll via the press shoe.

As a result of the heating, the fibers of the material web are plasticized, which produces the desired surface smoothness and the desired gloss.

By way of the extended nip, as compared with calenders without an extended nip, a prolonged residence time in the nip is achieved, uniform compaction of the material web being ensured at the same time by the soft shell of the shoe roll.

However, in the known calender arrangements, it is a problem that the shells used are restricted to about 10 MPa with regard to the admissible compressive stresses, since otherwise the damage or destruction of a shell can follow. Furthermore, in connection with extended press shoes, there are problems in the formation of a pressure cushion for transmitting force.

What is needed in the art is a calender arrangement such that a compressive stress of up to 30 MPa can be transmitted without the shell being damaged or destroyed in the process.

SUMMARY OF THE INVENTION

The present invention provides a calendar arrangement such that a compressive stress up to 30 MP can be transmitted without the shell being damaged or destroyed.

The present invention comprises, in one form thereof, starting from a calender arrangement, a shell including a base layer located radially on the inside and an adjacent functional layer located radially on the outside. The base layer includes a resilient matrix material reinforced by embedded fibers and the functional layer includes a matrix material with a lower fiber content than the base layer.

As a result of dividing the shell into a base layer and a functional layer, a structure of the shell which is optimized for use in extended nip calenders is achieved. The base layer with embedded fibers can be configured in such a way that high compressive stresses of up to 30 MPa can be produced in the extended nip without any damage to or destruction of the shell. At the same time, the functional layer with a lower fiber content can be designed to be so soft that the parameters required for the calendering can be maintained, so that, in particular, the necessary matching of the shell to the press shoe is ensured and secondly undesired nonuniformity in the compaction of the material web is prevented.

According to an advantageous embodiment of the invention, the shell is constructed as a substantially self-supporting tube. This can be achieved in particular via an appropriately high proportion of fibers in the base layer of the shell. At the same time, the functional layer advantageously includes a substantially fiber-free material, so that the functional layer thus forms a layer dominated by the matrix material used. As opposed to the shells of known calenders, the shell according to the present invention is thus advantageously not formed by a relatively "slack" belt which is brought into a cylindrical shape only by the centrifugal forces occurring during rotation; instead, the shell according to the present invention advantageously forms a tube-like body, even in the quiescent state, which is designed to absorb substantially higher compressive stresses in the extended nip.

According to a further preferred embodiment of the present invention, a sliding layer is provided on the radial inner side of the shell in order to reduce the friction between the shell and the press shoe. In this case, the sliding layer can include a substantially fiber-free matrix material and, in particular, can be designed to be harder than the matrix material in the base layer and/or the functional layer. As a result, the frictional forces occurring during operation between the press shoe and the inner side of the shell are minimized. The sliding layer can be formed by at least part of the base or as a separate layer.

It is also possible for the matrix material of the sliding layer and the base layer and/or the matrix material of the sliding layer and the functional layer to include the same material. In particular, the matrix material of the base layer and/or the functional layer and/or, if appropriate, the sliding layer can be a plastic, in particular a thermosetting plastic or a thermoplastic.

According to a further advantageous embodiment of the present invention, the radial thickness of the base layer is about 3 mm to 30 mm, in particular about 5 mm to 20 mm. The radial thickness of the functional layer can advantageously be about 5 mm to 20 mm, in particular about 15 mm. As a result of these advantageous thicknesses, an optimal combination of high admissible compressive stress loadings and, at the same time, high resilience of the outer side of the shell is achieved.

Advantageously, the fiber content of the base layer and/or the functional layer can decrease radially outward from the inside. In this case, the fiber content is preferably equal to zero, at least in the radially outer region of the functional layer. As a result of the fiber content decreasing radially outward, account is taken of the requirements of an extended nip calender, so that uniform compaction of the material web in the extended nip is ensured. In particular, the average fiber content of the base layer can be about 40% to 70% by volume, in particular about 50% to 60% by volume, preferably about 55% by volume, while the average fiber content of the functional layer can preferably be about 5% to 20% by volume, in particular about 8% to 12% by volume.

The embedded fibers are formed as glass and/or carbon fibers and/or as metal fibers and/or as metal-coated fibers. Depending on the fibers used, the physical properties, in particular of the base layer, can be controlled. For example, as a result of the use of carbon or metal fibers, the rigidity of the base layer can be increased considerably, its thermal conductivity likewise being increased considerably at the same time.

The fibers can be arranged in immediately successive fiber layers, in particular fiber layers spaced apart from one another. The fiber layers can advantageously each include fiber bundles wound at an angle to the axis of rotation of the shell and running substantially parallel to one another, the angular positions of the fiber bundles with respect to the axis of rotation of the shell being different for different fiber layers. In particular, it is advantageous if, for different fiber layers, the angular position of the fiber bundles increases radially outward. As a result of the different angular positions, the rigidity, in particular of the base layer, can be increased, it being possible for the thermal expansion behavior in the longitudinal direction to be controlled specifically at the same time.

According to a further advantageous embodiment of the present invention, the matrix material of the base layer and the functional layer includes the same material. In addition, the fibers of the base layer and, if appropriate, the fibers of the functional layer can include the same fibrous material. In principle, however, it is also possible to choose both the matrix material and the fibrous material for the base layer and the functional layer independently of one another, in order thereby to optimize the respective design parameters of the corresponding layers.

According to a further advantageous embodiment of the present invention, supporting elements with a convex supporting surface are arranged in the circumferential direction along the inner side of the material. These supporting elements can be arranged at regular intervals, in particular in each case offset by 90°, 180° and 270° with respect to the press shoe. The supporting elements achieve further stiffening of the resilient shell, so that the loading of the resilient shell in operation can be reduced, which is important in order to transmit high pressures without inadmissible deformation of the shell. In this case, the supporting elements can be provided with a friction-reducing cover on their surface.

According to a further preferred embodiment of the present invention, at least one supporting element with a convex supporting surface is arranged along the inner side of the shell in the region of the entry and/or the exit side of the press shoe. In this case, supporting elements, in particular arranged symmetrically, are preferably provided on both sides of the press shoe. By way of these further supporting elements, the shell of the shoe press can be supported before the entry into and out of the exit from the extended nip, in order to reduce the deformations which arise as a result of the guidance by the concave press shoe and in this way to prevent an increase in pressure.

All the supporting elements cited in this disclosure can be constructed as pressure elements, that is to say constructed in a manner similar to the press shoe for producing a pressure against the inner side of the shell of the shoe roll.

According to a further advantageous embodiment of the present invention, the extended nip has a length of 3 cm to 20 cm, in particular of 4 cm to 15 cm, preferably of 4 cm to 10 cm, in the transport direction of the material web.

By way of the shell constructed in accordance with the present invention, compressive stresses of up to 30 MPa can be transmitted to the shell of the shoe roll over these specified nip widths without the press shell being destroyed in the process.

The press shoe advantageously has a resilient mating surface, over which the shell is guided. As opposed to press shoes which are used in rolls with a metallic shell, in the case of the soft shell according to the present invention, a resilient contact surface of the press shoe is needed in order to avoid markings in the calendered material web. Use is therefore advantageously made of a press shoe which has a uniform construction with a resilient contact surface, a distribution of the pressure elements both over the length and over the width of the nip being possible here also, in order to achieve pressure profiling within the extended nip.

Further advantageous embodiments of the invention are specified in the dependent claims.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
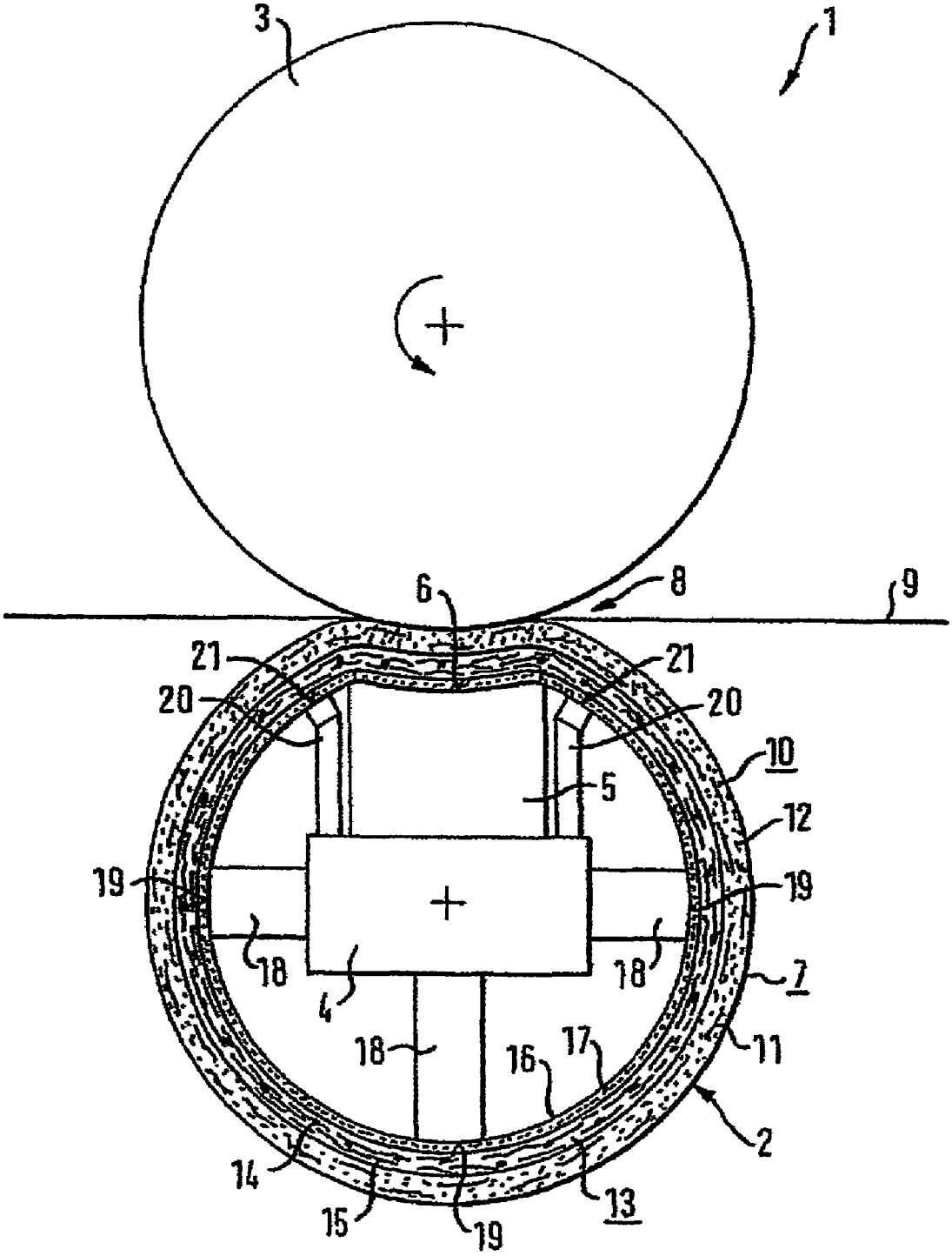
FIG. 1 is a schematic cross-sectional view through a calender arrangement constructed in accordance with an embodiment of the present invention.

Referring now to the drawings, and more particularly to FIG. 1, there is shown a calendar arrangement 1 which includes a shoe roll 2 and a mating roll 3. The mating roll 3 can in this case be constructed in a known way, for example as a heatable metal roll.

The shoe roll 2 includes a supporting beam 4 fixed in position, on which a press shoe 5 is mounted in a manner such that a concave pressing surface 6 of the press shoe 5 can be loaded in the direction of the mating roll 3. In this case, the concave pressing surface 6 is substantially matched to the outer surface of the mating roll 3.

Arranged around supporting beam 4 and press shoe 5 is a resilient shell 7 which, in the absence of mating roll 3, has the form of a cylindrical tube.

During operation, shoe roll 2 and mating roll 3 are guided toward each other in such a way that mating roll 3 comes into contact with the outer side of shell 7 of shoe roll 2 in the region of press shoe 5, as a result of which shell 7 assumes the concave shape corresponding to pressing surface 6 of press shoe 5, as illustrated in FIG. 1. In this way, an extended nip 8, through which a material web 9 is guided in order to be calendered, is formed between mating roll 3 and shoe roll 2.

By way of press shoe 5, the contact pressure acting on material web 9 in extended nip 8 can be controlled, so that, as a result of the action of heat via the heatable mating roll 3 and pressure, the desired surface property of material web 9 is achieved as it is guided through the extended nip 8.

Shell 7 has a functional layer 10 which is located radially on the outside and which includes a resilient matrix material, in particular a resin/hardener combination. As indicated in FIG. 1, fillers, for example in the form of fibers 11, are embedded in functional layer 10, but the proportion by volume of fibers 11 is relatively low, so that the functional layer represents a layer dominated by matrix material 12.

Functional layer 10 can also be completely free of fibers 11. Because of the low proportion of fibers, functional layer 10 is relatively soft, so that uniform compaction of material web 9 in the extended nip 8 is ensured.

Functional layer 10 is adjoined radially inward by a base layer 13 of shell 7, which includes a resilient matrix material 14 with fibers 15 embedded therein. The proportion of fibers 15 is in this case substantially higher than in functional layer 10, so that base layer 13 has a very high rigidity as compared with functional layer 10. This high rigidity ensures that shell 7 can be loaded with very high compressive stresses in extended nip 8 without there being any destruction of shell 7. As a result, the formation of an adequate pressure cushion for the transmission of force to the material web in extended nip 8 is ensured.

Base layer 13 is adjoined radially on the inside by a sliding layer 16, whose fiber content is again considerably lower than the fiber content of base layer 13 and, in particular, can likewise be equal to zero. Sliding layer 16 has a very low coefficient of friction on its inner side which, for example, can be achieved by a relatively hard matrix material 17 of sliding layer 16. By way of sliding layer 16, the friction during operation between shell 7 and press shoe 5 is reduced, it being possible at the same time for a lubricant in the form of an oil film to be introduced between sliding layer 16 and pressing surface 6 of press shoe 5.

Beginning from press shoe 5, additional supporting elements 18 are provided at 90° intervals in each case, each having a convex supporting surface 19 which comes to rest on the inner side of shell 7 and is matched to the shape of the inner surface of shell 7.

Supporting elements 18 can in this case be loaded radially outward in a manner similar to press shoe 5, so that shell 7 is additionally supported in its cylindrical form by supporting elements 18.

Provided on both sides of press shoe 5 are further supporting elements 20, which come to rest on the inner side of shell 7 immediately in the region of the entry and the exit side of press shoe 5 and therefore prevent excessive deformation of shell 7 in these regions. Supporting elements 20 therefore also have supporting surfaces 21 which are substantially convexly matched to the inner side of shell 7.

Figure 2:
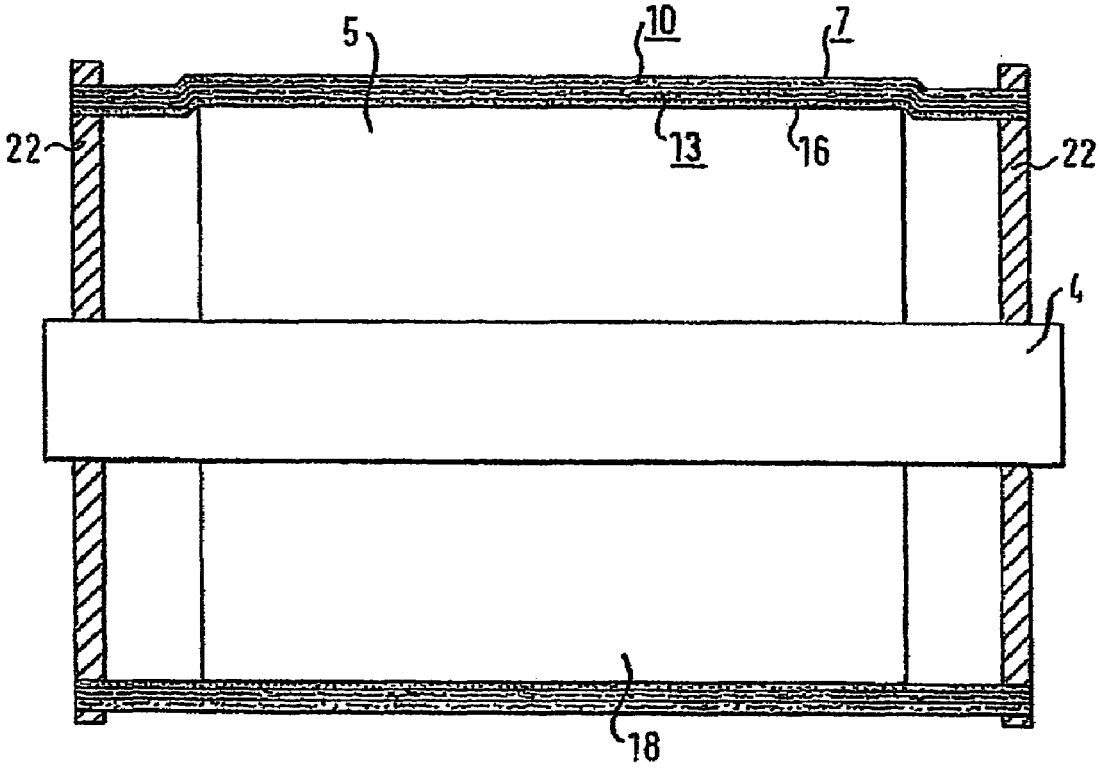
FIG. 2 is a schematic longitudinal cross-sectional view through the shoe roll according to FIG. 1 constructed in accordance with an embodiment of the present invention.

The longitudinal section of FIG. 2 reveals that the multilayer construction of shell 7 including functional layer 10, base layer 13 and sliding layer 16 also extends over the length of shell 7. Shell 7 is fixed, for example clamped or screwed, at its ends in each case to two terminating elements 22 which are arranged at the ends and formed as disks and which are mounted such that they can rotate with respect to supporting beam 4. As a result of the reinforced and, in particular, substantially self-supporting construction of shell 7, sagging between the two terminating elements 22 is prevented, so that the stressing of shell 7 during operation can be reduced considerably.

Furthermore, it can be seen from FIG. 2 that shell 7 is pressed radially outward by press shoe 5. This prevents the sections of shell 7 located axially outside the region of press shoe 5 being pressed against hot mating roll 3, by which elements shell 7 can be destroyed. In the region of press shoe 5, adequate insulation is produced by the material web 9 present between shell 7 and the heated mating roll 3.

By way of supporting element 18, as opposed to press shoe 5, shell 7 is merely supported but not pressed substantially radially outward, so that the stressing of shell 7 by supporting element 18 and, in an analogous way, by the further supporting elements 18 which cannot be seen in FIG. 2, is kept low.

As a result of the multilayer construction according to the present invention of shell 7, it is possible to build up the compressive stress needed during the calendering of material webs 9, in particular of graphic papers, without the shell being destroyed under these high compressive stresses. In addition, many standard elements which are already used in what are known as controlled deflection rolls can be used, so that economic production of a corresponding roll according to the present invention is possible.

List of designations

| | |
|---|---|
| 1 | Calender arrangement |
| 2 | Shoe roll |
| 3 | Mating roll |
| 4 | Supporting beam |
| 5 | Press shoe |
| 6 | Pressing surface |
| 7 | Shell |
| 8 | Extended nip |
| 9 | Material web |
| 10 | Functional layer |
| 11 | Fibers |
| 12 | Matrix material |
| 13 | Base layer |
| 14 | Matrix material |
| 15 | Fibers |
| 16 | Sliding layer |
| 17 | Matrix material |
| 18 | Supporting element |
| 19 | Supporting surface |
| 20 | Supporting element |
| 21 | Supporting surface |
| 22 | Terminating elements |

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the appended claims.

What is claimed is:

1. A calender arrangement for calendering a fiber web, comprising:

a mating roll;

a shoe roll including a revolving shell being fixed to two rotatably mounted terminating elements, each of two said rotatably mounted terminating elements being arranged at an end of said revolving shell, said shoe roll being loaded in a direction of said mating roll via a press shoe matched to an outside of said mating roll, said revolving shell having a base layer located radially on an inside of said revolving shell and an adjacent functional layer located radially on an outside of said revolving shell, said base layer including a resilient matrix material reinforced by a plurality of embedded fibers, said functional layer including a matrix material with another plurality of embedded fibers having a lower fiber content than said base layer; and an extended nip formed between said shoe roll and said mating roll, the fiber web being guided through said extended nip.

2. The calender arrangement of claim 1, wherein said fiber web is a paper web.

3. The calender arrangement of claim 1, wherein said revolving shell is constructed as a substantially self-supporting tube.

4. The calender arrangement of claim 1, wherein said functional layer includes a substantially fiber-free matrix material.

5. The calender arrangement of claim 1, further including a sliding layer being provided radially on said inside of said revolving shell in order to reduce a friction between said revolving shell and said press shoe.

6. The calender arrangement of claim 5, wherein said sliding layer includes a substantially fiber-free matrix material.

7. The calender arrangement of claim 5, wherein said sliding layer is formed by at least part of said base layer.

8. The calender arrangement of claim 5, wherein said sliding layer is formed as a separate layer.

9. The calender arrangement of claim 5, wherein said sliding layer includes a sliding layer matrix material, at least one of said sliding layer matrix material and said resilient matrix material including a same material and said sliding layer matrix material and said matrix material including said same material.

10. The calender arrangement of claim 9, wherein said sliding layer matrix material is harder than at least one of said resilient matrix material and said matrix material.

11. The calender arrangement of claim 9, wherein at least one of said sliding layer matrix material, said resilient matrix material and said matrix material is a plastic.

12. The calender arrangement of claim 11, wherein said plastic is one of a thermosetting plastic and a thermoplastic.

13. The calender arrangement of claim 1, wherein a radial thickness of said base layer is approximately between 3 mm and 30 mm.

14. The calender arrangement of claim 1, wherein a radial thickness of said base layer is approximately between 5 mm and 20 mm.

15. The calender arrangement of claim 1, wherein a radial thickness of said functional layer is approximately between 5 mm and 20 mm.

16. The calender arrangement of claim 1, wherein a radial thickness of said functional layer is approximately 15 mm.

17. The calender arrangement of claim 1, wherein at least one of a fiber content of said base layer decreases radially from said inside to said outside and said lower fiber content decreases radially from said inside to said outside.

18. The calender arrangement of claim 1, wherein at least in a radially outer region of said functional layer said lower fiber content is equal to zero.

19. The calender arrangement of claim 1, wherein an average fiber content of said base layer is approximately between 40% by volume and 70% by volume.

20. The calender arrangement of claim 1, wherein an average fiber content of said base layer is approximately between 50% by volume and 60% by volume.

21. The calender arrangement of claim 1, wherein an average fiber content of said base layer is approximately 55% by volume.

22. The calender arrangement of claim 1, wherein an average fiber content of said functional layer is approximately between 5% by volume and 20% by volume.

23. The calender arrangement of claim 1, wherein an average fiber content of said functional layer is approximately between 8% by volume and 12% by volume.

24. The calender arrangement of claim 1, wherein at least one of said plurality of embedded fibers and said another plurality of embedded fibers are formed as at least one of a plurality of glass fibers, a plurality of carbon fibers, a plurality of metal fibers and a plurality of metal-coated fibers.

25. The calender arrangement of claim 1, wherein at least one of said plurality of embedded fibers and said another plurality of embedded fibers includes a mixture of a plurality of glass fibers and a plurality of carbon fibers, which are in each case distributed substantially uniformly over a length of said revolving shell, a ratio of said mixture of said glass fibers to said carbon fibers being approximately between 60/40 and 90/10.

26. The calender arrangement of claim 25, wherein said ratio of said mixture of said glass fibers to said carbon fibers is approximately 70/30.

27. The calender arrangement of claim 1, wherein at least one of said plurality of embedded fibers and said another plurality of embedded fibers are arranged in a plurality of immediately successive fiber layers.

28. The calender arrangement of claim 27, wherein said plurality of immediately successive fiber layers are spaced apart from one another.

29. The calender arrangement of claim 27, further including an axis of rotation of said revolving shell, wherein said plurality of immediately successive fiber layers each include a plurality of fiber bundles wound at an angle to said axis of rotation and running substantially parallel to one another, a plurality of angular positions are associated with said plurality of fiber bundles, said plurality of angular positions of the fiber bundles, with respect to said axis of rotation, are different for different said fiber layers.

30. The calender arrangement of claim 29, wherein said angular positions of said fiber bundles increases radially outward for different said fiber layers.

31. The calender arrangement of claim 30, wherein said angular positions of an inner said fiber layers is approximately between 30° and 40°.

32. The calender arrangement of claim 30, wherein said angular positions increases in steps of approximately between 10° and 20°.

33. The calender arrangement of claim 30, wherein said angular positions increases in steps of approximately 15°.

34. The calender arrangement of claim 29, wherein respective said fiber bundles of two said immediately successive fiber layers run in opposite directions, said angular positions of said fiber bundles of said two immediately successive fiber layers are symmetrical with respect to a cross-sectional area of said shoe roll.

35. The calender arrangement of claim 1, wherein said resilient matrix material of said base layer and said matrix material of said functional layer includes a same material.

36. The calender arrangement of claim 1, wherein said plurality of embedded fibers of said base layer and said another plurality of embedded fibers of said functional layer include a same fiber material.

37. The calender arrangement of claim 1, further including a plurality of supporting elements each with a convex supporting surface, said plurality of supporting elements being arranged in a circumferential direction along an inner side of said revolving shell.

38. The calender arrangement of claim 37, wherein said plurality of supporting elements are arranged at regular intervals.

39. The calender arrangement of claim 38, wherein said plurality of supporting elements are offset by 90°, 180° and 270° with respect to said press shoe.

40. The calender arrangement of claim 37, wherein at least one of said plurality of supporting elements with said convex supporting surface is arranged on an inner side of said revolving shell in a region of at least one of an entry side of said press shoe and an exit side of said press shoe.

41. The calender arrangement of claim 5, wherein at least one of said resilient matrix material of said base layer, said matrix material of said functional layer and said sliding layer includes a resin/hardener combination.

42. The calender arrangement of claim 1, wherein said extended nip has a length in a transport direction of the material web of approximately between 3 cm and 20 cm.

43. The calender arrangement of claim 42, wherein said length is approximately between 4 cm and 15 cm.

44. The calender arrangement of claim 42, wherein said length is approximately between 4 cm and 10 cm.

45. The calender arrangement of claim 1, wherein said press shoe has a resilient pressing surface over which said revolving shell is guided.

46. The calender arrangement of claim 1, wherein at least one of said plurality of embedded fibers of said base layer have a higher thermal conductivity than said resilient matrix material and said another plurality of embedded fibers of said functional layer have a higher thermal conductivity than said matrix material.

47. The calender arrangement of claim 1, further including a plurality of additional fillers being arranged in at least one of said base layer and said functional layer.

48. The calender arrangement of claim 47, wherein said plurality of additional fillers are in a powder form.

49. The calender arrangement of claim 47, wherein a thermal conductivity of said additional fillers is higher than a thermal conductivity of at least one of said matrix material and said resilient matrix material.

50. The calender arrangement of claim 49, wherein said plurality of additional fillers include at least one of carbon and metal.

* * * * *

UNITED STATES PATENT AND TRADEMARK OFFICE

CERTIFICATE OF CORRECTION

PATENT NO. : 7,287,974 B2
APPLICATION NO. : 11/224220
DATED : October 30, 2007
INVENTOR(S) : Rheims et al.

It is certified that error appears in the above-identified patent and that said Letters Patent is hereby corrected as shown below:

COLUMN 6

At lines 50 and 51, please delete "each of two said rotatably", and substitute therefore --each of said two rotatably--.

Signed and Sealed this

Twelfth Day of August, 2008

JON W. DUDAS
*Director of the United States Patent and Trademark Office*